US008888259B2

(12) United States Patent
Atwood et al.

(10) Patent No.: US 8,888,259 B2
(45) Date of Patent: Nov. 18, 2014

(54) INDUCTION INK MELTER

(71) Applicant: Xerox Corporation, Norwalk, CT (US)

(72) Inventors: Mark A. Atwood, Rush, NY (US); Timothy P. Foley, Marion, NY (US); Douglas Allen Gutberlet, Ontario, NY (US); Frank Berkelys Tamarez Gomez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 85 days.

(21) Appl. No.: 13/849,078

(22) Filed: Mar. 22, 2013

(65) Prior Publication Data

US 2014/0285595 A1 Sep. 25, 2014

(51) Int. Cl.
*B41J 2/175* (2006.01)

(52) U.S. Cl.
CPC ..... *B41J 2/17593* (2013.01)
USPC ..... 347/88

(58) Field of Classification Search
None
See application file for complete search history.

(56) References Cited

U.S. PATENT DOCUMENTS

2012/0147073 A1* 6/2012 Dahrea et al. ..... 347/7
2012/0147105 A1* 6/2012 Jones et al. ..... 347/88
2013/0044165 A1* 2/2013 Leighton et al. ..... 347/88

OTHER PUBLICATIONS

Induction Technology Corporation and Ambrell Precision Induction Heating; Efficient Induction Melting Systems; http://melting.ambrell.com; 411-0140-10 Rev A; 12 Pages.

* cited by examiner

*Primary Examiner* — Geoffrey Mruk
*Assistant Examiner* — Bradley Thies
(74) *Attorney, Agent, or Firm* — Maginot Moore & Beck LLP

(57) ABSTRACT

A melting device melts solid ink into liquid ink by passing alternating current through an electrical conductor arranged in coils around a housing. The liquid ink passes from a reservoir, through a spool valve arrangement, and into first and second chambers. The spool valve arrangement only allows liquid ink into one chamber at a time. While the first chamber is being filled, pressure is applied to the second chamber. The pressure applied to the second chamber forces the liquid ink in the second chamber through a filter and an outlet. When the first chamber is filled to a predetermined level, pressure is no longer applied to the second chamber and is applied to the first chamber. The pressure applied to the first chamber moves the spool valve arrangement to block the first chamber. While pressure is applied to the first chamber, the second chamber is filled with liquid ink.

20 Claims, 8 Drawing Sheets

INDUCTION INK MELTER

TECHNICAL FIELD

This disclosure relates generally to machines that melt phase change ink and, specifically to machines that use induction heating to melt phase change ink.

BACKGROUND

The word "printer" as used herein encompasses any apparatus, such as a digital copier, book marking machine, facsimile machine, multi-function machine, etc., that produces an image with a colorant on recording media for any purpose. Inkjet printers have one or more printheads that eject drops of liquid ink from inkjet ejectors to form the image on the surface of an image receiving surface. Full color inkjet printers typically use a plurality of ink reservoirs to store a number of differently colored inks for printing. A commonly known full color printer has four ink reservoirs. Each reservoir stores a different color ink, namely, cyan, magenta, yellow, and black ink, for the generation of full color images.

By way of example, FIG. 8 depicts a prior art continuous web inkjet printer 800. In the embodiment shown, the printer 800 implements a process for printing onto a continuous media web. The continuous web printer system 800 includes twenty print modules 880-899, a controller 828, a memory 829, guide roller 815, guide rollers 816, pre-heater roller 818, apex roller 820, leveler roller 822, tension sensors 852A-852B, 854A-854B, and 856A-856B, and velocity sensors, such as encoders 860, 862, and 864. The print modules 880-899 are positioned sequentially along a media path P and form a print zone from a first print module 880 to a last print module 899 for forming images on a print medium 814 as the print medium 814 travels past the print modules. Each print module 880-883 provides a magenta ink. Each print module 884-887 provides cyan ink. Each print module 888-891 provides yellow ink. Each print module 892-895 provides black ink. Each print module 896-899 provides a clear ink as a finish coat. In all other respects, the print modules 880-899 are substantially identical. The media web travels through the media path P guided by rollers 815 and 816, pre-heater roller 818, apex roller 820, and leveler roller 822. A heated plate 819 is provided along the path adjacent roller 815. In FIG. 6, the apex roller 820 is an "idler" roller, meaning that the roller rotates in response to engaging the moving media web 814, but is otherwise uncoupled from any motors or other drive mechanisms in the printing system 800. The pre-heater roller 818, apex roller 820, and leveler roller 822 are each examples of a capstan roller that engages the media web 814 on a portion of its surface. A brush cleaner 824 and a contact roller 826 are located at one end 834 of the media path P. A heater 830 and a spreader 832 are located at the opposite end 836 of the media path P.

Operation and control of the various subsystems, components and functions of printing system 800 are performed with the aid of a controller 828 and memory 829. In particular, controller 828 monitors the velocity and tension of the media web 814 and determines timing of ink drop ejection from the print modules 880-899. The controller 828 can be implemented with general or specialized programmable processors that execute programmed instructions. Controller 828 is operatively connected to memory 829 to enable the controller 828 to read instructions and to read and write data required to perform the programmed functions in memory 829. Memory 829 can also hold one or more values that identify tension levels for operating the printing system with at least one type of print medium used for the media web 814. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

As illustrated in FIG. 8, each of the print modules 880-899 includes an array of printheads that are arranged across the width of both the first section of web media and second section of web media. Ink ejectors in each printhead in the array of printheads are configured to eject ink drops onto predetermined locations of both the first and second sections of media web 814. To provide ink for the printheads in the print modules to eject onto the continuous web 814, a solid ink delivery system receives phase change ink in solid form, such as pellets or ink sticks, and then transports the solid ink to a melting assembly where the solid phase change ink is heated to a temperature sufficient to melt the solid phase change ink. The melted phase change ink is then delivered to a reservoir and, subsequently, to the printheads in a printhead module for jetting onto a surface of web 814. Once the solid ink is melted, the ink is maintained at a temperature that preserves the liquid state of the ink to enable ejection of the ink by the inkjet ejectors in the printheads of modules 880-899, while maintaining sufficient tackiness to enable the ink to adhere to the surface of the web 814. In printers that use solid ink to produce images, melting the ink in a manner that produces liquid ink more quickly and energy efficiently is a desirable goal.

SUMMARY

A melting device for melting phase change ink in a solid inkjet printer has been developed. The melting device includes a housing essentially comprised of a ferrous material and including an inlet, an outlet, a reservoir fluidly communicating with the inlet, and a pair of chambers fluidly communicating with the reservoir and the outlet. The melting device also includes an electrical conductor configured in a plurality of loops surrounding the housing and a pressure source in fluid communication with the pair of chambers within the housing. The melting device also includes a first valve positioned between the pair of chambers and the reservoir and configured to be selectively operated to enable phase change ink melted within the housing to flow into the pair of chambers. The melting device also includes a pair of pressure inlets positioned between the pressure source and each of the chambers within the housing. The pressure inlets are configured to be selectively operated to enable pressurized fluid from the pressure source to enter the housing and urge melted phase change ink from the chambers into the outlet.

A melting assembly for melting phase change ink in a solid inkjet printer has been developed. The melting assembly includes a plurality of melting devices thermally insulated from a surrounding environment. Each melting device includes a housing essentially comprised of a ferrous material. The housing includes an inlet, an outlet, a reservoir fluidly communicating with the inlet, and a pair of chambers fluidly communicating with the reservoir and the outlet. Each melting device also includes an electrical conductor configured in a plurality of loops surrounding the housing. Each melting device also includes a pressure source in fluid communication with the pair of chambers within the housing and a first valve positioned between the pair of chambers and the reservoir. The first valve is configured to be selectively operated to enable melted phase change ink to flow into the pair of chambers. Each melting device also includes a pair of pressure inlets positioned between the pressure source and each of the chambers within the housing. The pressure inlets are configured to be selectively operated to enable pressurized fluid from the pressure source to enter the housing and urge melted phase change ink from the chambers into the outlet.

BRIEF DESCRIPTION OF THE DRAWINGS

The foregoing aspects and other features of a melting device and a melting assembly for melting phase change ink in a solid inkjet printer are explained in the following description, taken in connection with the accompanying drawings.

DETAILED DESCRIPTION

Figure 1:
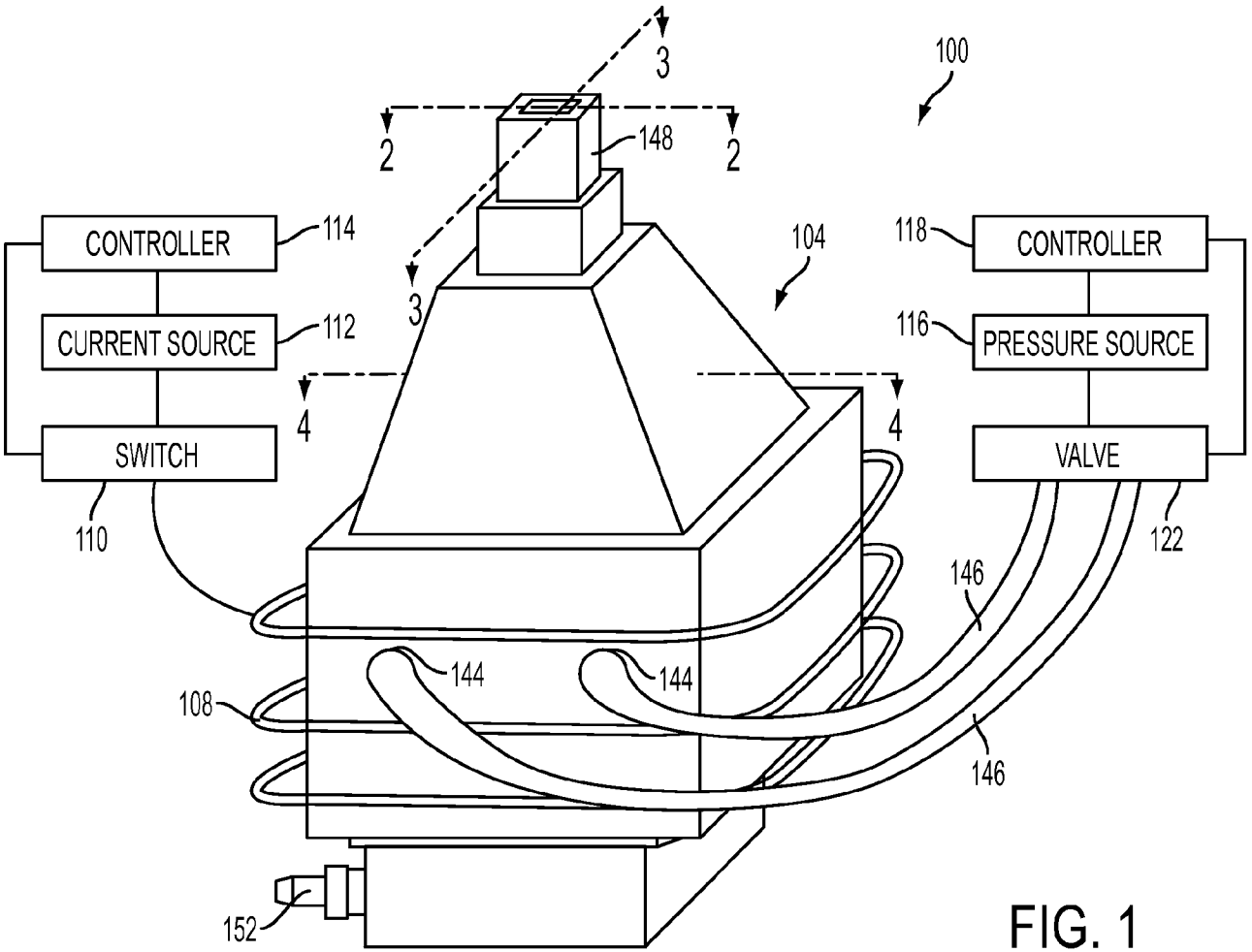
FIG. 1 is a front perspective view of a melting device including a housing and an electrical conductor.

The description below and the accompanying figures provide a general understanding of the environment for the melting device and melting assembly disclosed herein as well as the details for the device and assembly. In the drawings, like reference numerals are used throughout to designate like elements.

Figure 8:
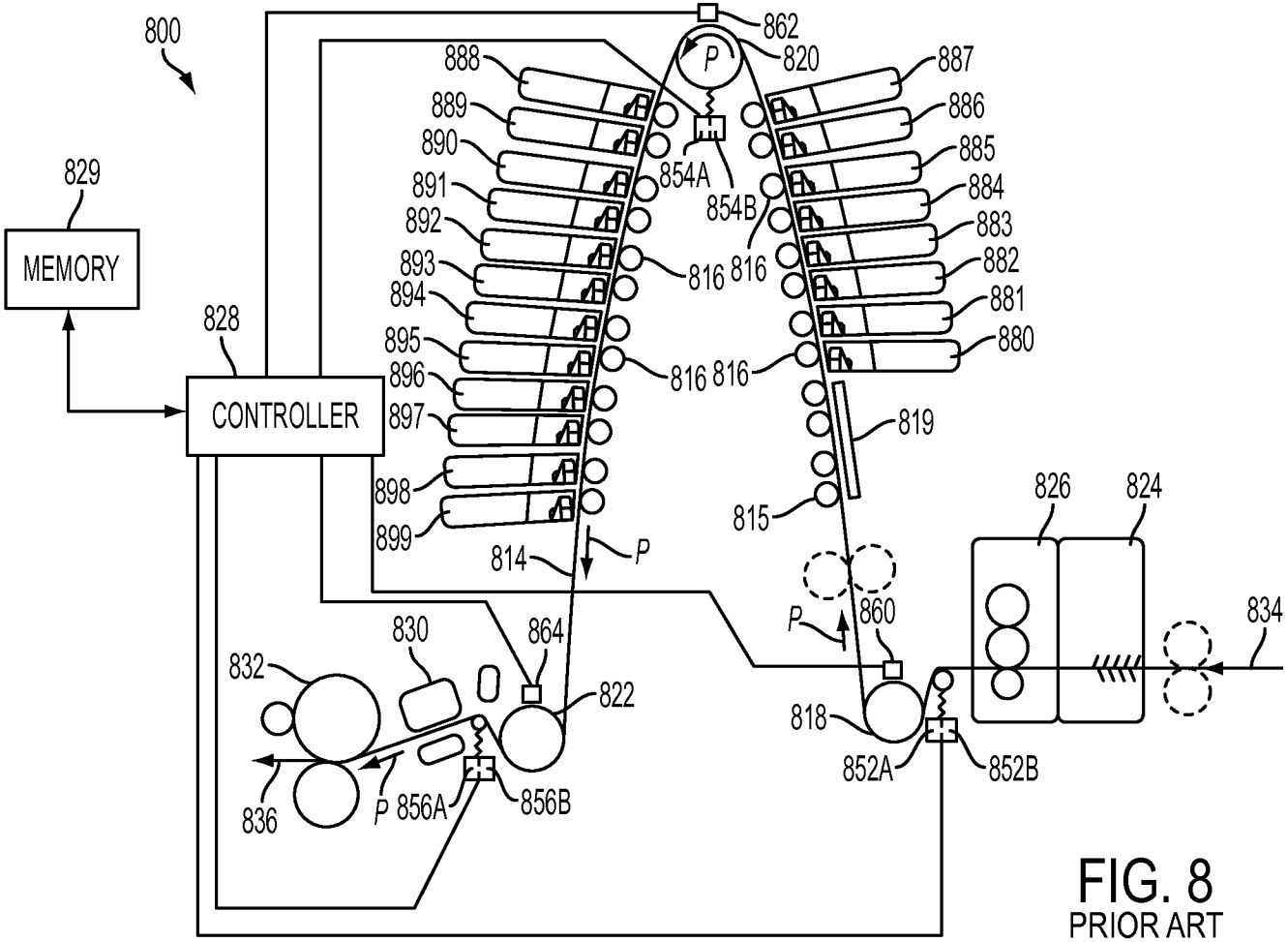
FIG. 8 PRIOR ART
FIG. 8 is a schematic drawing of a prior art continuous web inkjet printing system.

FIG. 1 is a schematic view of a melting device 100 for use in a phase change ink printer, such as printer 800 shown in FIG. 8. The melting device 100 includes a housing 104, an electrical conductor 108, an alternating current (AC) source 112, a temperature controller 114, a pressure source 116, and a pressure controller 118. The housing 104 is essentially comprised of a ferrous material such as, for example, die cast steel. The electrical conductor 108 is configured to encircle or loop around the housing 104 as a single loop induction coil. The AC source 112 is operatively connected to the electrical conductor 108 through a switch 110, which is operated by the controller 114, to couple alternating current to the electrical conductor 108 selectively. Thus, the temperature controller 114 regulates the flow of alternating current through the conductor 108. The pressure source 116 is operatively connected to two pressurized chambers within the housing 104 through a valve 122, which is operated by the pressure controller 118 to selectively pressurize the pressurized chambers and regulate the pressurization of space within the housing 104. In at least one embodiment, the temperature controller 114 and the pressure controller 118 are included in a single operating controller. The temperature controller 114 and the pressure controller 118 are, respectively, connected to the AC source 112 and the pressure source 116 to activate each source selectively.

The housing 104 includes a pair of pressure ports 144, a solid ink inlet 148, and a melted ink outlet 152. Each pressure port 144 is configured to mate with a conduit 146 operatively connected to the valve 122 to enable pressurized air to enter one of the two pressurized chambers within the housing 104. The solid ink inlet 148 is configured to receive solid phase change ink and deliver the solid ink to a solid ink supply chamber 154 (FIG. 2) in the housing 104. The liquid ink outlet 152 is configured to release melted phase change ink from the pressurized chambers within the housing 104.

Figure 2:
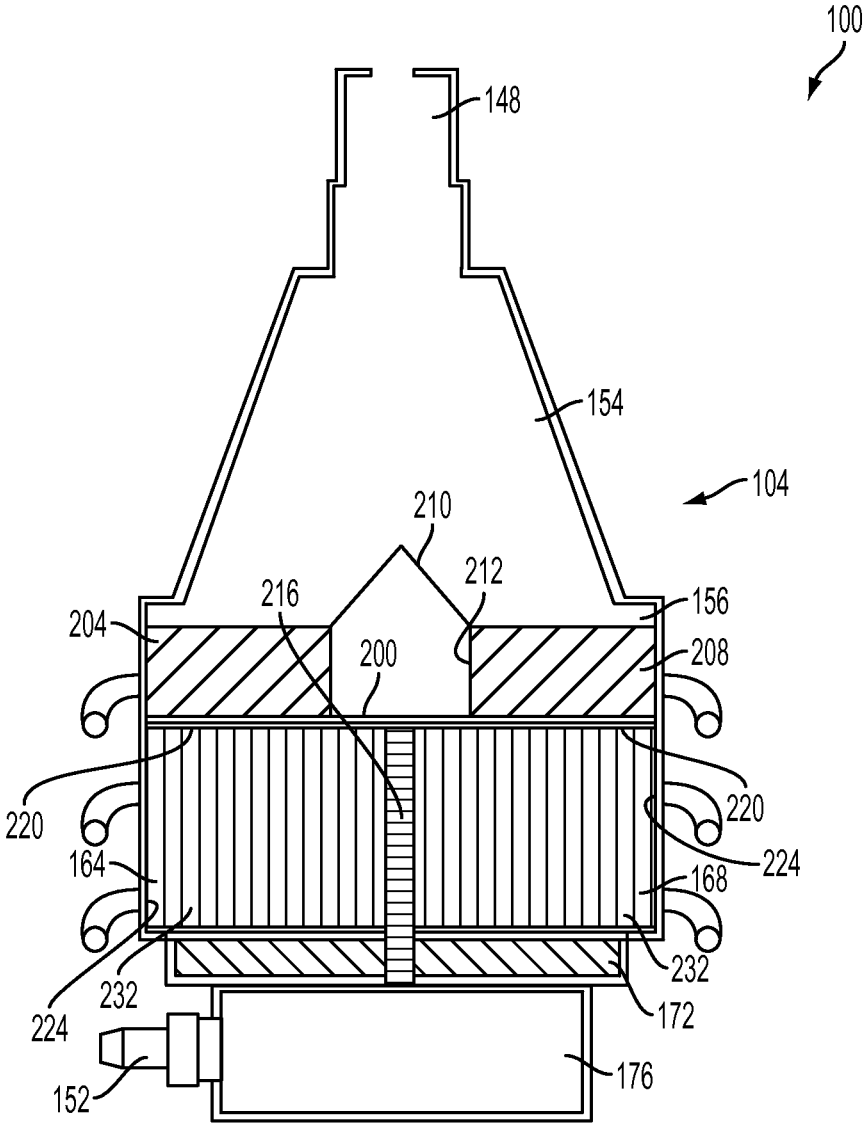
FIG. 2 is a front cross-sectional view of the melting device of FIG. 1.

Turning now to FIG. 2, a cross-section of the melting device 100 taken along the dashed-line 2-2 in FIG. 1 is depicted. As shown, the housing 104 further includes a melting chamber 156, a spool valve arrangement 160 (shown in FIG. 5 and FIG. 6), a first pressurized chamber 164, a second pressurized chamber 168, a filter 172, and a collection area 176. The melting chamber 156 is arranged adjacent to and in fluid communication with the solid ink supply chamber 154. The first pressurized chamber 164 and the second pressurized chamber 168 are arranged adjacent to and in fluid communication with the melting chamber 156. The spool valve arrangement 160 (shown in FIG. 5 and FIG. 6) is positioned within the first pressurized chamber 164, the second pressurized chamber 168, and the melting chamber 156. The filter 172 is arranged adjacent to and in fluid communication with the first pressurized chamber 164 and the second pressurized chamber 168. The collection area 176 is arranged adjacent to and in fluid communication with the filter 172 and with the melted ink outlet 152.

More specifically, the melting chamber 156 is open to the solid ink supply chamber 164 to enable the solid phase change ink to be gravity fed away from the inlet 148 and to enable the solid phase change ink to disperse and flow freely into the melting chamber 156. The melting chamber 156 includes a spool valve area 196 (shown in FIG. 3 and FIG. 4), a bottom surface 200, a first plurality of fins 204, a second plurality of fins 208, and a diverter 210. The bottom surface 200 is sloped downwardly toward the spool valve area 196. The first plurality of fins 204 and the second plurality of fins 208 extend upwardly and substantially perpendicularly from the bottom surface 200 of the melting chamber 156, but do not extend entirely to the solid ink supply chamber 154. Each fin of the first plurality of fins 204 is arranged parallel to the other fins of the first plurality of fins 204. Similarly, each fin of the second plurality of fins 208 is arranged parallel to the other fins of the second plurality of fins 208. In at least one embodiment, the fins of the first plurality of fins 204 are also arranged parallel to the fins of the second plurality of fins 208. Diverter 210 is positioned to divert solid ink units that enter the chamber 156 through opening 148 to either impinge on the first or the second plurality of fins.

The fins of the first plurality of fins 204 are spaced apart from one another such that the solid phase change ink received from the solid ink supply chamber 154 is able to disperse and flow freely between each fin of the first plurality of fins 204. Similarly, the fins of the second plurality of fins 208 are spaced apart from one another such that the solid phase change ink received from the solid ink supply chamber 154 is able to disperse and flow freely between each fin of the second plurality of fins 208. Additionally, the first plurality of fins 204 is spaced apart from the second plurality of fins 208 by a gap 212. The gap 212 is substantially aligned with the spool valve area 196 (shown in FIG. 3 and FIG. 4) and is arranged such that melted phase change ink that collects on the bottom surface 200 of the melting chamber 156 is gravity fed along the bottom surface 200 to the gap 212 and surface 200 is slanted towards the spool valve area 196 to enable the melted ink to flow into the spool valve arrangement 160 (shown in FIG. 5 and FIG. 6).

The first pressurized chamber 164 and the second pressurized chamber 168 are arranged alongside one another, are separated from one another by a median partition 216, and are substantially the same as each other. The first pressurized chamber 164 and the second pressurized chamber 168 are arranged below and in fluid communication with the melting chamber 156 via the spool valve arrangement 160 to receive melted phase change ink from the melting chamber 156 via the gravity fed spool valve arrangement 160.

Each of the first pressurized chamber 164 and the second pressurized chamber 168 has a top surface 220, an outer wall 224, a spool valve area 228 (shown in FIG. 3 and FIG. 3), and a plurality of fins 232. The top surface 220 of the first pressurized chamber 164 and the top surface 220 of the second pressurized chamber 168 are integrally formed with the bottom surface 200 of the melting chamber 156. The plurality of fins 232 of each of the first pressurized chamber 164 and the second pressurized chamber 168 extend downwardly and substantially perpendicularly from the top surface 220 but do not extend entirely to the filter 172. The outer walls 224 of the first pressurized chamber 164 and the second pressurized chamber 168 are arranged substantially parallel with the median partition 216. The pluralities of fins 232 in the first pressurized chamber 164 and the second pressurized chamber 168 extend from the outer wall 224 to the median partition 216 and are arranged substantially perpendicularly to the outer wall 224 and the median partition 216.

The fins of the plurality of fins 232 of the first pressurized chamber 164 are spaced apart from one another such that the melted phase change ink received from the melting chamber 156 via the spool valve arrangement 160 is able to disperse and flow freely between each fin of the plurality of fins 232. Similarly, the fins of the plurality of fins 232 of the second pressurized chamber 168 are spaced apart from one another such that the melted phase change ink received from the melting chamber 156 via the spool valve arrangement 160 is able to disperse and flow freely between each fin of the plurality of fins 232. Additionally, both the first pressurized chamber 164 and the second pressurized chamber 168 are open to the filter 172 to enable the melted phase change ink to pass out of the first pressurized chamber 164 and the second pressurized chamber 168 and through the filter 172 when pressure is applied to the first pressurized chamber 164 and the second pressurized chamber 168. The fins in the pressurized chambers are heated by the changing electromagnetic fields generated by the AC current in the electrical conductor to keep the melted ink at an appropriate temperature.

Figure 3:
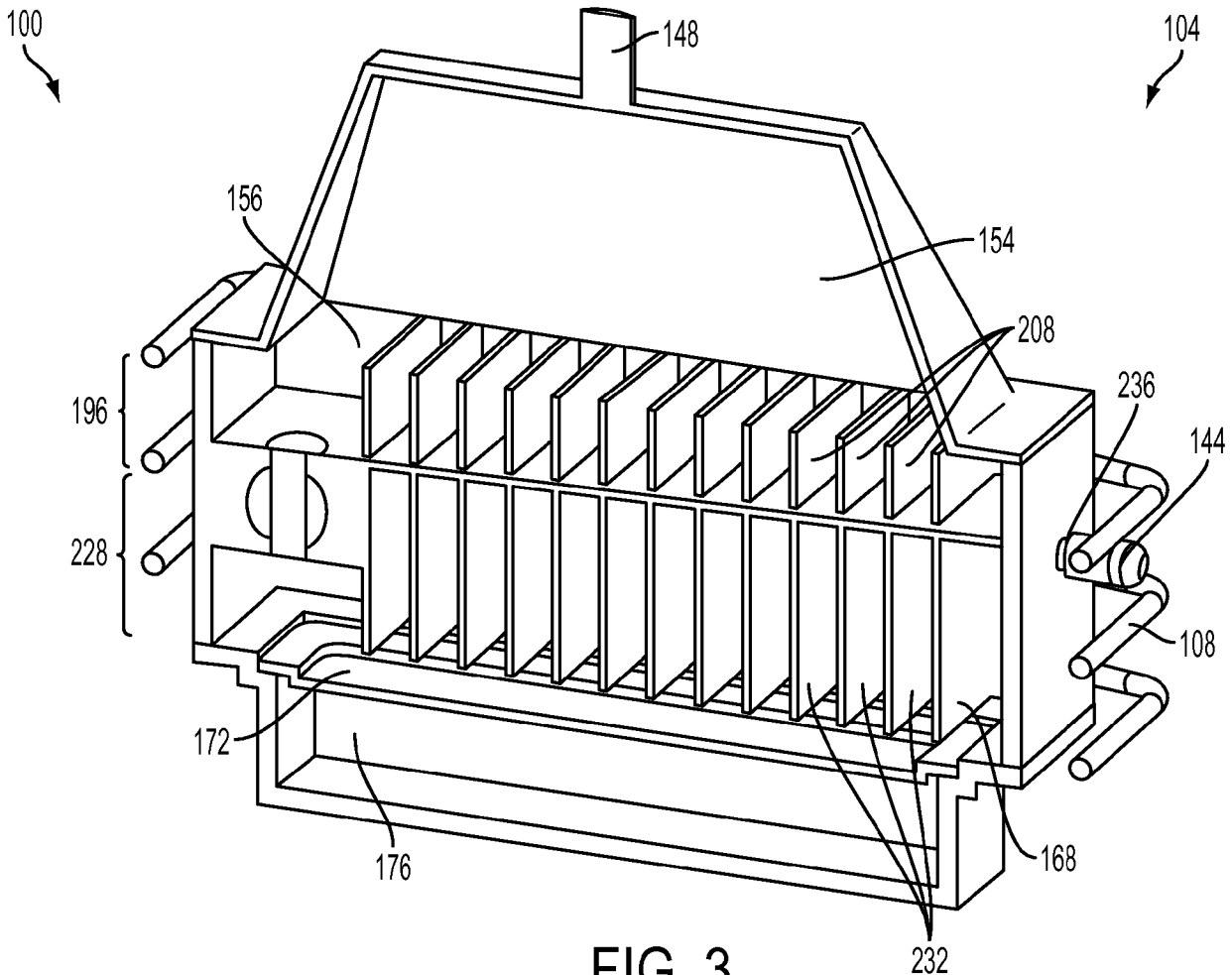
FIG. 3 is a side perspective cross-sectional view of the melting device of FIG. 1.

Turning now to FIG. 3, a cross-section of the melting device 100 taken along the dashed-line 3-3 in FIG. 1 is depicted to more clearly illustrate features within the housing 104. Only the second pressurized chamber 168 of the housing 104 is visible in FIG. 3. The first pressurized chamber 164, however, is substantially the same as the second pressurized chamber 168. Thus, description of the features of the second pressurized chamber 168 also applies to the first pressurized chamber 164. As shown, the second pressurized chamber 168 has a pressure inlet 236 through wall 224 arranged opposite the spool valve area 228 and the plurality of fins 232 is interposed between the pressure inlet 236 and the spool valve area 228.

The pressure inlet 236 extends through the housing 104 to the pressure port 144 so the second pressurized chamber 168 is in fluid communication with the valve 122 (shown in FIG. 1) via the pressure port 144 and the pressure inlet 236. The spool valve area 228 is configured to movably receive at least a portion of the spool valve arrangement 160 (shown in FIG. 5 and FIG. 6). The plurality of fins 232 is essentially comprised of the same material as the housing 104.

Figure 4:
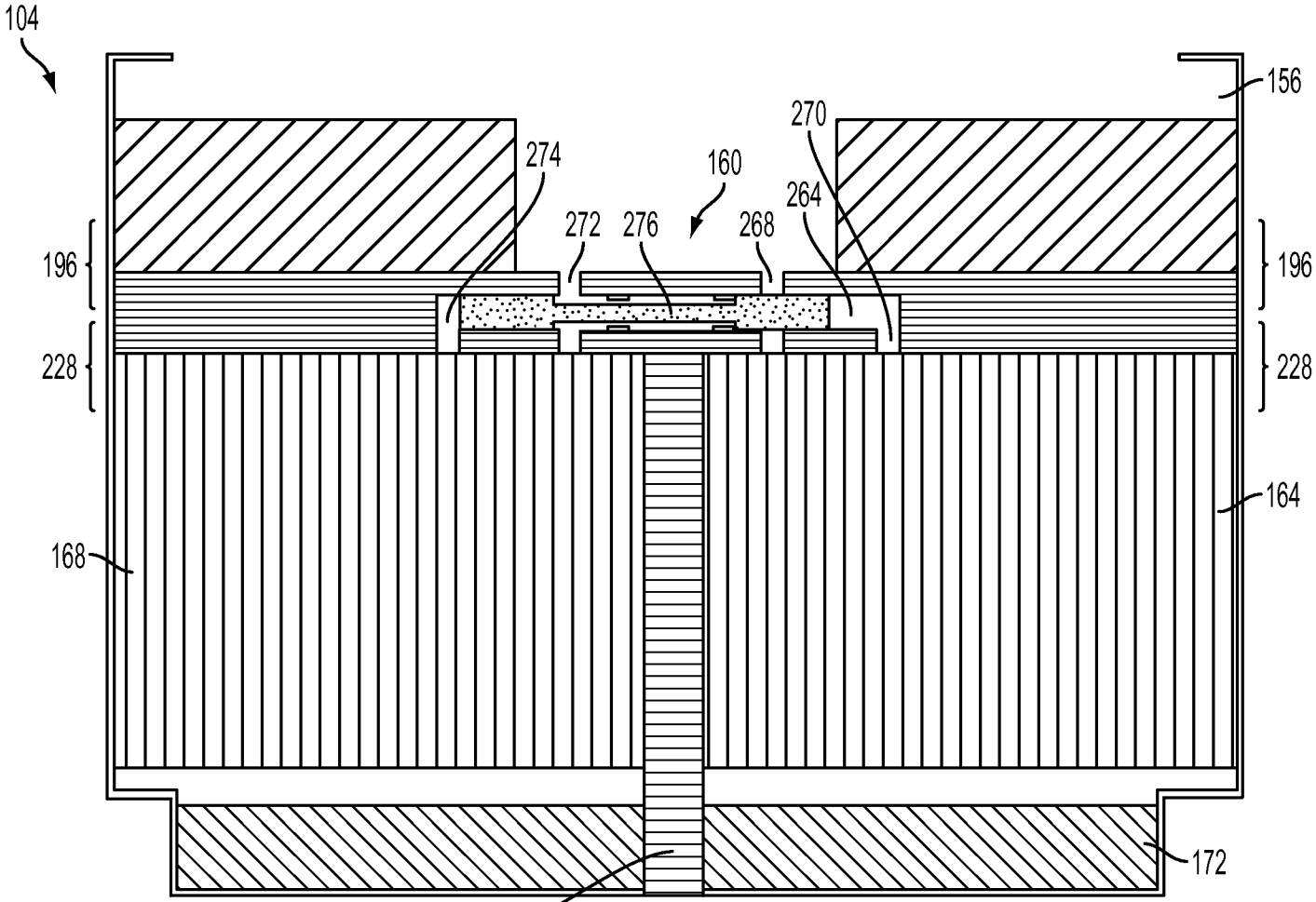
FIG. 4 is a back cross-sectional view of a portion of the melting device of FIG. 1.
Figure 5:
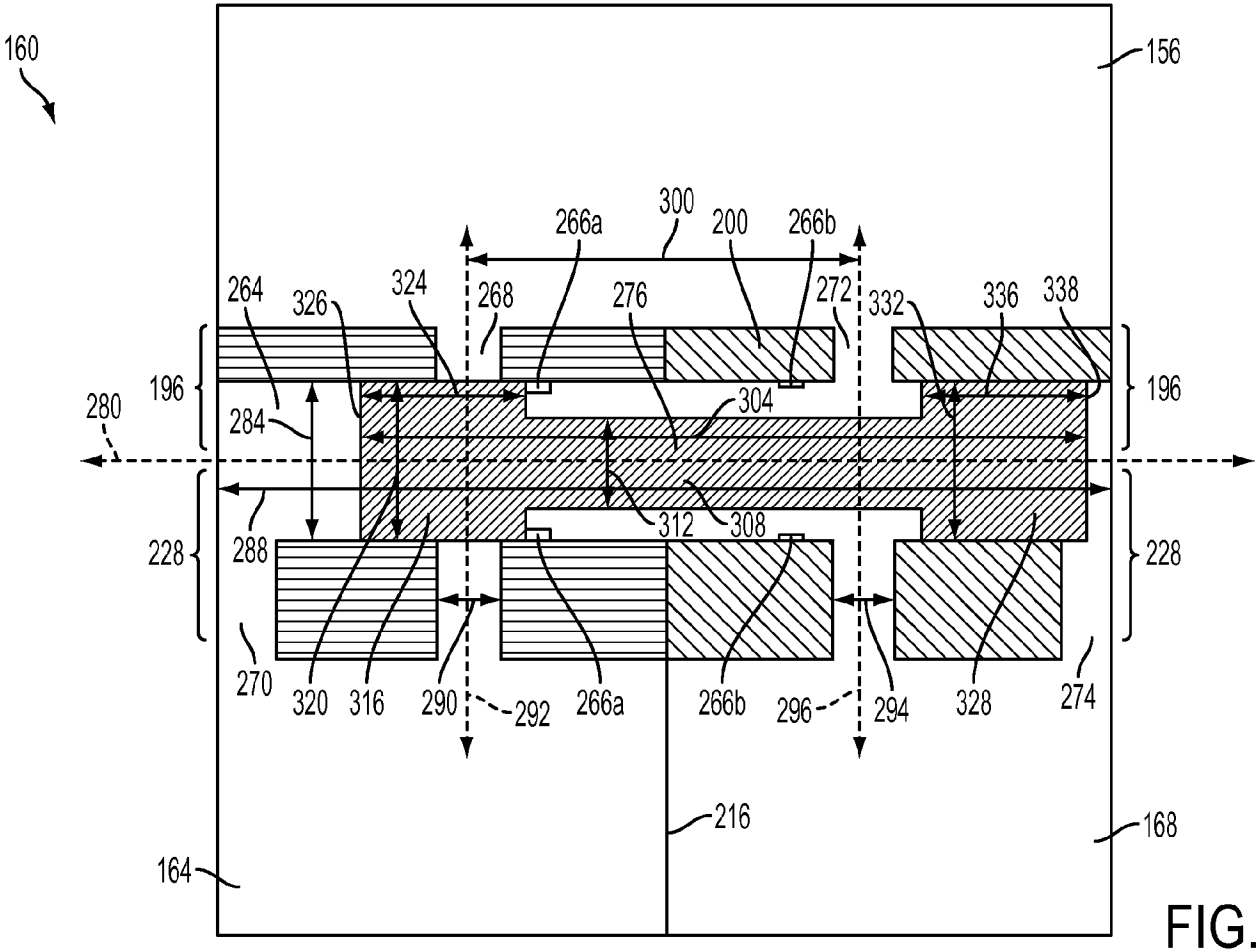
FIG. 5 is a front cross-sectional view of a valve arrangement of the melting device of FIG. 1 in a first position.

Turning now to FIG. 4, a cross-section of the housing 104 taken along the dashed-line 4-4 in FIG. 1 is depicted to more clearly illustrate features within the housing 104. As shown, the spool valve arrangement 160 is arranged within the spool valve area 196 of the melting chamber 156, the spool valve area 228 of the first pressurized chamber 164, and the spool valve area 228 of the second pressurized chamber 168. The spool valve arrangement 160 includes a valve chamber 264, a first access conduit 268, a first differential conduit 270, a second access conduit 272, a second differential conduit 274, and a spool valve 276. The valve chamber 264 extends horizontally through the access and differential conduits to enable the spool valve to translate within the valve chamber. The first access conduit 268 is in fluid communication with the melting chamber 156, the valve chamber 264, and the first pressurized chamber 164. The second access conduit 272 is in fluid communication with the melting chamber 156, the valve chamber 264, and the second pressurized chamber 168. The first differential conduit 270 is in fluid communication with the valve chamber 264 and the first pressurized chamber 168. The second differential conduit 274 is in fluid communication with the valve chamber 264 and the second pressurized chamber 168. When the spool valve 276 is positioned within the valve chamber 264 as shown in FIG. 5, the spool valve arrangement 160 is in a first position. When the spool valve 276 is positioned within the valve chamber 264 as shown in FIG. 6, the spool valve arrangement 160 is in a second position.

Figure 6:
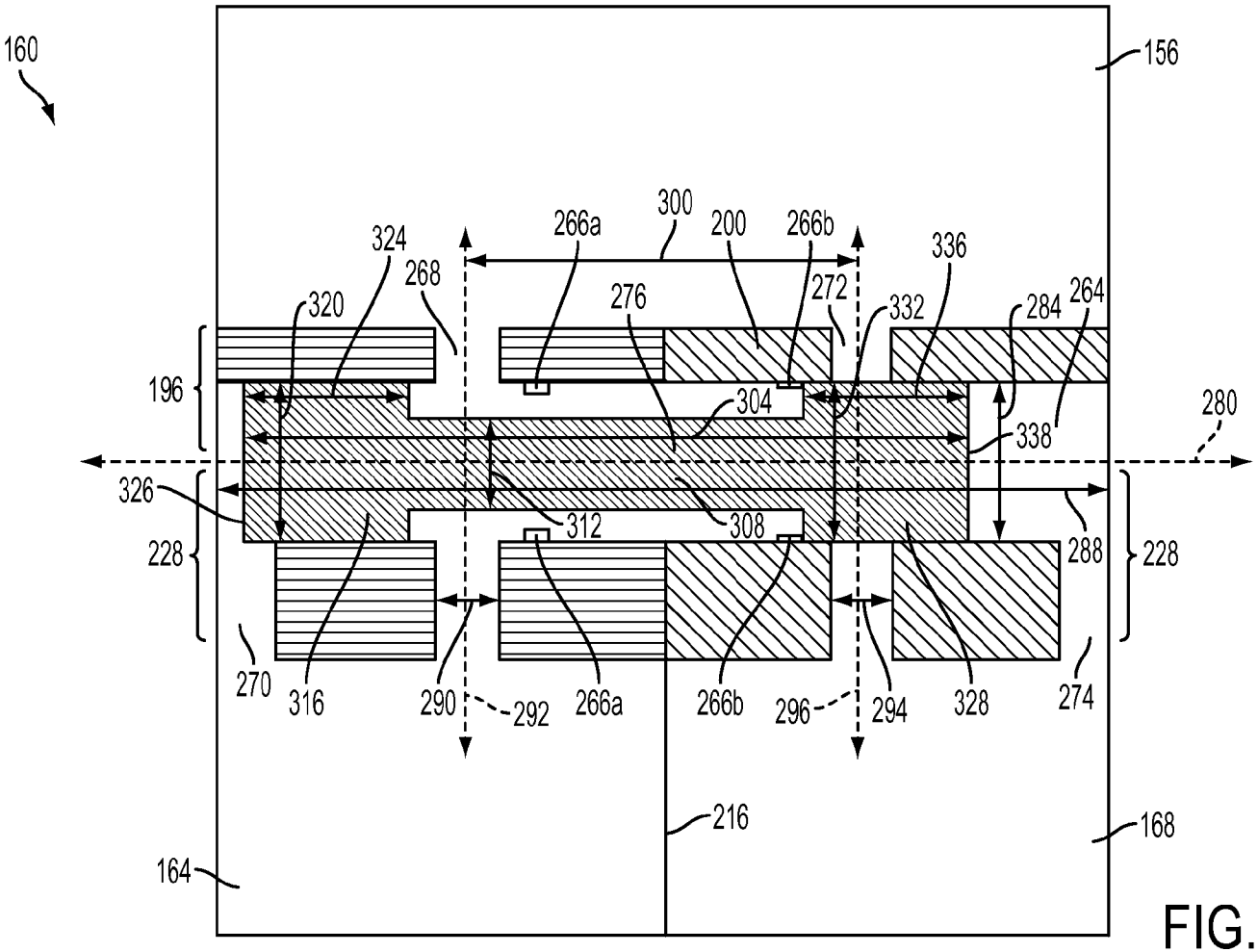
FIG. 6 is a front cross-sectional view of the valve arrangement of the melting device of FIG. 1 in a second position.

Turning now to FIG. 5 and FIG. 6, schematic drawings of cross-sectional views of the spool valve arrangement 160 are shown to illustrate more clearly features of the spool valve arrangement 160. The valve chamber 264 is substantially shaped as a cylindrical bore having a first stop 266*a*, a second stop 266*b*, a valve chamber axis 280, a valve chamber diameter 284, and a valve chamber length 288. The valve chamber 264 is formed through the spool valve area 228 of the first pressurized chamber 164 and the spool valve area 228 of the second pressurized chamber 168 such that the valve chamber axis 280 is arranged substantially perpendicularly to the median partition 216. The first stop 266*a* extends from the spool valve area 228 of the first pressurized chamber 164 and the spool valve area 196 of the melting chamber 156 and projects inwardly toward the valve chamber axis 280. Likewise, the second stop 266*b* extends from the spool valve area 228 of the second pressurized chamber 168 and the spool valve area 196 of the melting chamber 156 and projects inwardly toward the valve chamber axis 280.

The first access conduit 268 is substantially shaped as a bore having a first access conduit diameter 290 and a first access conduit axis 292. The first access conduit 268 is formed through the bottom surface 200 of the melting chamber 156 and extends into the valve chamber 264 such that the first access conduit axis 292 is substantially perpendicular to the valve chamber axis 280. The first access conduit 268 fluidly connects the melting chamber 156 to the first pressurized chamber 164 via the valve chamber 264. Similarly, the second access conduit 272 is substantially shaped as a bore having a second access conduit diameter 294 and second access conduit axis 296. The second access conduit 272 is formed through the bottom surface 200 of the melting chamber 156 and extends into the valve chamber 264 such that the second access conduit axis 296 is substantially perpendicularly to the valve chamber axis 280. The second access conduit 272 fluidly connects the melting chamber 156 to the second pressurized chamber 168 via the valve chamber 264. The first access conduit axis 292 and the second access conduit axis 296 are spaced apart from one another along the valve chamber axis 280 by a distance 300.

The spool valve 276 is substantially shaped as a spool having a spool length 304. The spool length 304 is smaller than the valve chamber length 288 to allow the spool valve 276 to move within the valve chamber 264 along the valve chamber axis 280. The spool valve 276 has a base cylinder 308 with a base diameter 312, a first land 316 with a first land diameter 320, a first land length 324, and a first land outside face 326, and a second land 328 with a second land diameter 332, a second land length 336, and a second land outside face 338. The base diameter 312 is smaller than the first land diameter 320 and the second land diameter 332. The first land diameter 320 is substantially the same as the second land diameter 332. The spool valve 276 is configured to fit tightly within the valve chamber 264, but still slide under pressure within the chamber 264. Accordingly, the first land diameter 320 and the second land diameter 332 are slightly smaller than the valve chamber diameter 284.

The first land length 324 is substantially the same as the second land length 336. The spool valve 276 is sized and configured such that when the first land 316 is aligned with the first access conduit 268, the second land 328 is not aligned with the second access conduit 272. More specifically, the first land length 324 is longer than the first access conduit diameter 290 such that when the spool valve arrangement 160 is in the first position (shown in FIG. 5), the first land 316 is aligned with the first access conduit 268, and the first land 316 entirely blocks the fluid connection between the melting chamber 156 and the first pressurized chamber 164. Likewise, the second land length 336 is longer than the second access conduit diameter 294 such that when the spool valve arrangement 160 is in the second position (shown in FIG. 6), the second land 328 is aligned with second access conduit 272, and the second land 328 entirely blocks the fluid connection between the melting chamber 156 and the second pressurized chamber 168. Additionally, the spool length 304 is larger than the distance 300 such that when the spool valve arrangement 160 is in the first position (shown in FIG. 5), the first land 316 is aligned with the first access conduit 268, and the second land 328 is not aligned with the second access conduit 272. Likewise, when the spool valve arrangement is in the second position (shown in FIG. 6), the second land 328 is aligned with the second access conduit 272, and the first land 316 is not aligned with the first access conduit 268. Accordingly, only one of the first pressurized chamber 164 and the second pressurized chamber 168 is in fluid communication with the melting chamber 156 at a time.

Returning to FIG. 4, the filter 172 is arranged adjacent to and in fluid communication with the first pressurized chamber 164 (shown in FIG. 2) and the second pressurized chamber 168 to receive liquid phase change ink from the first pressurized chamber 164 (shown in FIG. 2) and the second pressurized chamber 168. The filter 172 abuts the median partition 216 such that the first pressurized chamber 164 is not in fluid communication with the second pressurized chamber 168 at the filter 172. The filter 172 is comprised of a material having a porosity that resists unaided fluid passage through the filter 172. In other words, when fluid collects on and rests against the filter 172, the filter 172 blocks the fluid and acts as a substantially non-porous barrier. However, when additional pressure is applied to the fluid, the filter 172 acts as a porous barrier and deforms to allow the fluid to pass through.

Returning to FIG. 2, the collection area 176 is arranged adjacent to and in fluid communication with the filter 172 to receive filtered liquid phase change ink from the filter 172. The collection area 176 is also arranged adjacent to and in fluid communication with the outlet 152 to expel filtered liquid phase change ink from the collection area 176 and from the housing 104. When pressure is applied to the collection area 176, fluid, including liquid phase change ink, in the collection area 176 is expelled through the outlet 152 and does not pass back through the filter 172.

In operation, turning first to FIG. 1, when a print operation is initiated, the temperature controller 114 transmits a signal to the AC source 112 to generate alternating current. The temperature controller 114 also operates the switch 110 to connect or disconnect the AC source 112 to the electrical conductor 108 to provide alternating current to the electrical conductor 108. When the switch 110 connects the AC source 112 to the electrical conductor 108, the housing 104, surrounded by the coiled electrical conductor 108, is subjected to changing electromagnetic fields generated by the conductor as the alternating current passes through the electrical conductor 108. Because the housing 104 is essentially comprised of a ferrous material, the changing electromagnetic fields produce eddy currents in the housing and fins that generate heat as they overcome resistance within the ferrous material of the housing 104 and the fins 204, 208 and 232. Accordingly, the alternating current heats the housing 104, as well as all components within the housing 104 that are made of the same ferrous material as the housing 104, to a uniform predetermined temperature. The predetermined temperature is greater than the melting temperature of the phase change ink. The predetermined temperature is, for example, approximately 115 degrees Celsius.

A temperature sensor (not shown) is configured to detect the temperature of the housing 104 and/or the components within the housing 104 that are made of the same ferrous material as the housing 104 and to transmit the detected temperature to the temperature controller 114. The temperature sensor can be, for example, a thermistor. The temperature sensor can be, for example, integrated into the housing 104, into the melting chamber 156, or into a fin in the first plurality of fins 204 or the second plurality of fins 208 (shown in FIG. 2). When the detected temperature transmitted to the temperature controller 114 from the temperature sensor is less than the predetermined temperature, the temperature controller 114 operates the switch 110 to connect the AC source 112 to the electrical conductor 108 to heat the housing 104 and components. When the detected temperature transmitted to the temperature controller 114 from the temperature sensor is greater than the predetermined temperature, the temperature controller 114 operates the switch 110 to disconnect the AC source 112 from the electrical conductor 108 to stop heating the housing 104 and components.

Turning now to FIG. 3, solid phase change ink is forced into the housing 104 through the inlet 148. The solid phase change ink passes through the inlet 148 and into the solid ink supply chamber 154. The pressure that forces the solid phase change ink through the inlet 148, along with gravity, causes the solid phase change ink to move from the solid ink supply chamber 154 into the melting chamber 156 where the solid phase change ink is free to disperse and to move among the first plurality of fins 204 and the second plurality of fins 208. Because the first plurality of fins 204 and the second plurality of fins 208 are heated to the predetermined temperature along with the housing 104, the phase change ink contacting and moving about the first plurality of fins 204 and the second plurality of fins 208 within the melting chamber 156 is heated to a temperature greater than its melting temperature and melts into liquid phase change ink. The liquid phase change ink accumulates on the bottom surface 200 of the melting chamber 156 and is gravity fed toward the spool valve area 196.

Next, returning to FIG. 1, the pressure controller 118 transmits a signal to the pressure source 116 to generate pressure. The pressure controller 118 also operates the valve 122 to supply the pressure generated by the pressure source 116 to either the first pressurized chamber 164 (shown in FIG. 2) or the second pressurized chamber 168 via the respective conduit 146. The valve 122 applies pressure to one of the first pressurized chamber 164 (shown in FIG. 2) and the second pressurized chamber 168 (shown in FIG. 3) by transmitting fluid, for example, air, generated by the pressure source 116 through the corresponding conduit 146, through the corresponding pressure port 144 and through corresponding pressure inlet 252 into the corresponding chamber 164 or 168.

By way of example, the spool valve arrangement 160 begins in the first position (shown in FIG. 5). When the spool valve arrangement 160 is in the first position, the first pressurized chamber 164 is not in fluid communication with the melting chamber 156, because the first access conduit 268 is blocked by the first land 316. The second pressurized chamber 168, however, is in fluid communication with the melting chamber 156 via the second access conduit 272 and the valve chamber 264. The liquid phase change ink on the bottom surface 200 of the melting chamber is gravity fed through the second access conduit 272 into the second pressurized chamber 168. The liquid phase change ink is free to move and disperse among the plurality of fins 232 (shown in FIG. 3) within the second pressurized chamber 168 and to accumulate and rest on the filter 172 (shown in FIG. 2). Because the plurality of fins 232 is essentially comprised of the same ferrous material as the housing 104, the liquid phase change ink is maintained at the predetermined temperature and therefore remains liquid.

While the second pressurized chamber 168 is filling with liquid phase change ink, the pressure controller 118 (shown in FIG. 1) is applying pressure to the first pressurized chamber 164 (shown in FIG. 2) by operating the valve 122 to transmit fluid generated by the pressure source 116 to the first pressurized chamber 164 via the corresponding conduit 146 (shown in FIG. 1). The pressure enters the first pressurized chamber 164, enters the first access conduit 268 below the spool valve 276, and passes through the first differential conduit 270 to fill the valve chamber 264 to the left of the first land 316. Accordingly, pressure is applied to the first land outside face 326 and forces the spool valve 276 rightwardly within the valve chamber 264. The spool valve 276 is limited in its rightward movement by contact of the first land 316 with the first stop 266*a*. While the spool valve 276 is positioned rightwardly within the valve chamber 264, the first access conduit 268 is blocked by the first land 316. Accordingly, the only outlet for the pressure being applied to the first pressurized chamber 164 is through the filter 172. Thus, the pressure applied by the valve 122 (shown in FIG. 1) forces the liquid phase change ink to pass through the filter 172 (shown in FIG. 3) and into the collection area 176. The pressure applied by the valve 122 (shown in FIG. 1) further ejects the filtered liquid phase change ink in the collection area 176 through the outlet 152 and into a liquid ink delivery system (not shown) to deliver the ink to printheads such as printheads 28 (shown in FIG. 8), thereby evacuating the first pressurized chamber 164.

While the first pressurized chamber 164 is being evacuated, the second pressurized chamber 168 continues to fill with liquid phase change ink. When the amount of liquid phase change ink in the second pressurized chamber 168 reaches a predetermined amount, a level sensor (not shown) in the second pressurized chamber 168 transmits a signal to the pressure controller 118 (shown in FIG. 1). The level sensor can be, for example, integrated into the outer wall 224 (shown in FIG. 2) of the second pressurized chamber 168 or into the plurality of fins 232 (shown in FIG. 3) within the second pressurized chamber 168. In the present embodiment, the level sensor is configured to detect when an amount of liquid phase change ink in a chamber that is being filled reaches a predetermined maximum amount. In an alternative embodiment, however, the level sensor can be configured to detect when the amount of liquid phase change ink in a chamber that is being evacuated reaches a predetermined minimum amount.

When the level sensor in the second pressurized chamber 168 transmits a signal to the pressure controller 118, the pressure controller 118 stops operating the valve 122 (shown in FIG. 1) to apply pressure generated by the pressure source 116 (shown in FIG. 1) to the first pressurized chamber 164 and begins operating the valve 122 to apply pressure generated by the pressure source 116 to the second pressurized chamber 168. As shown in FIG. 5, because the first stops 266*a* prevents the spool valve 276 from moving all the way to the right side of the valve chamber 264, the second land outside face 338 within the valve chamber 264 is exposed to the pressure applied to into the second pressurized chamber 168 and thus into the second differential conduit 274. When the valve 122 applies pressure by transmitting fluid to the second pressurized chamber 168, the pressure is applied to the second land outside face 338 via the second differential conduit 274. Applying pressure to the second land outside face 338 forces the spool valve 276 leftwardly within the valve chamber 264.

As shown in FIG. 6, the spool valve 276 is limited in its leftward movement by contact of the second land 316 with the second stop 266*b*. While the spool valve 276 is positioned leftwardly within the valve chamber 264, the spool valve arrangement 160 is in the second position and the second access conduit 272 is blocked by the second land 328 while the first access conduit 170 is no longer blocked by the first land 316. Thus, when the spool valve arrangement 160 is in the second position, the first pressurized chamber 164 is in fluid communication with the melting chamber 156 via the first access conduit 268 and the valve chamber 264, and the liquid phase change ink on the bottom surface 200 of the melting chamber 156 is gravity fed through the first access conduit 268 into the first pressurized chamber 164. The liquid phase change ink is free to move and disperse among the plurality of fins 232 (shown in FIG. 2) within the first pressurized chamber 164 and to accumulate and rest on the filter 172 (shown in FIG. 2). Because the plurality of fins 232 is essentially comprised of the same ferrous material as the housing 104, the liquid phase change ink is maintained at the predetermined temperature and therefore remains liquid.

While the first pressurized chamber 164 is filling with liquid phase change ink, the pressure controller 118 (shown in FIG. 1) is applying pressure to the second pressurized chamber 168 (shown in FIG. 2) by operating the valve 122 to transmit fluid generated by the pressure source 116 to the second pressurized chamber 168 via the corresponding conduit 146 (shown in FIG. 1). The pressure enters the second pressurized chamber 168, enters the second access conduit 272 below the spool valve 276, and passes through the second differential conduit 274 to fill the valve chamber 264 to the right of the second land 328. Accordingly, pressure is applied to the second land outside face 338 and forces the spool valve 276 leftwardly within the valve chamber 264. The spool valve 276 is limited in its leftward movement by contact of the second land 328 with the second stop 266*b*. While the spool valve 276 is positioned leftwardly within the valve chamber 264, the second access conduit 272 is blocked by the second land 328. Accordingly, the only outlet for the pressure being applied to the second pressurized chamber 168 is through the filter 172. The pressure applied by the valve 122 (shown in FIG. 1) forces the liquid phase change ink to pass through the filter 172 (shown in FIG. 3) and into the collection area 176. The pressure applied by the valve 122 (shown in FIG. 1) further ejects the filtered liquid phase change ink in the collection area 176 through the outlet 152 and into a liquid ink delivery system (not shown) to deliver the ink to printheads 28 (shown in FIG. 8), thereby evacuating the second pressurized chamber 168.

While the second pressurized chamber 168 is being evacuated, the first pressurized chamber 164 continues to fill with liquid phase change ink. When the amount of liquid phase change ink in the first pressurized chamber 164 reaches a predetermined amount, a level sensor (not shown) in the first pressurized chamber 164 transmits a signal to the pressure controller 118 (shown in FIG. 1). The level sensor can be, for example, integrated into the outer wall 224 (shown in FIG. 2) of the first pressurized chamber 164 or into the plurality of fins 232 within the first pressurized chamber 164. In the present embodiment, the level sensor is configured to detect when an amount of liquid phase change ink in a chamber that is being filled reaches a predetermined maximum amount. In an alternative embodiment, however, the level sensor can be configured to detect when the amount of liquid phase change ink in a chamber that is being evacuated reaches a predetermined minimum amount.

When the level sensor in the first pressurized chamber 164 transmits a signal to the pressure controller 118, the pressure controller 118 stops operating the valve 122 (shown in FIG. 1) to apply pressure to the second pressurized chamber 168 and again operates the valve 122 to apply pressure to the first pressurized chamber 164.

Accordingly, the melting device 100 melts solid phase change ink into liquid phase change ink in the melting chamber 156 (shown in FIG. 1) and continually passes the liquid phase change ink through one of the first pressurized chamber 164 (shown in FIG. 2) and the second pressurized chamber 168 (shown in FIG. 2) to the printheads 28 (shown in FIG. 8). In this manner, a reliable supply of melted phase change ink is provided to the printheads in the printing modules enabling printing operations to be carried out more efficiently. Additionally, less liquid phase change ink is kept in a chamber at a time enabling more efficient and more uniform heating and temperature maintenance of the liquid phase change ink. The increased efficiency, in turn, enables the melting device 100 to be smaller and more compactly configured than melting devices of the prior art.

Figure 7:
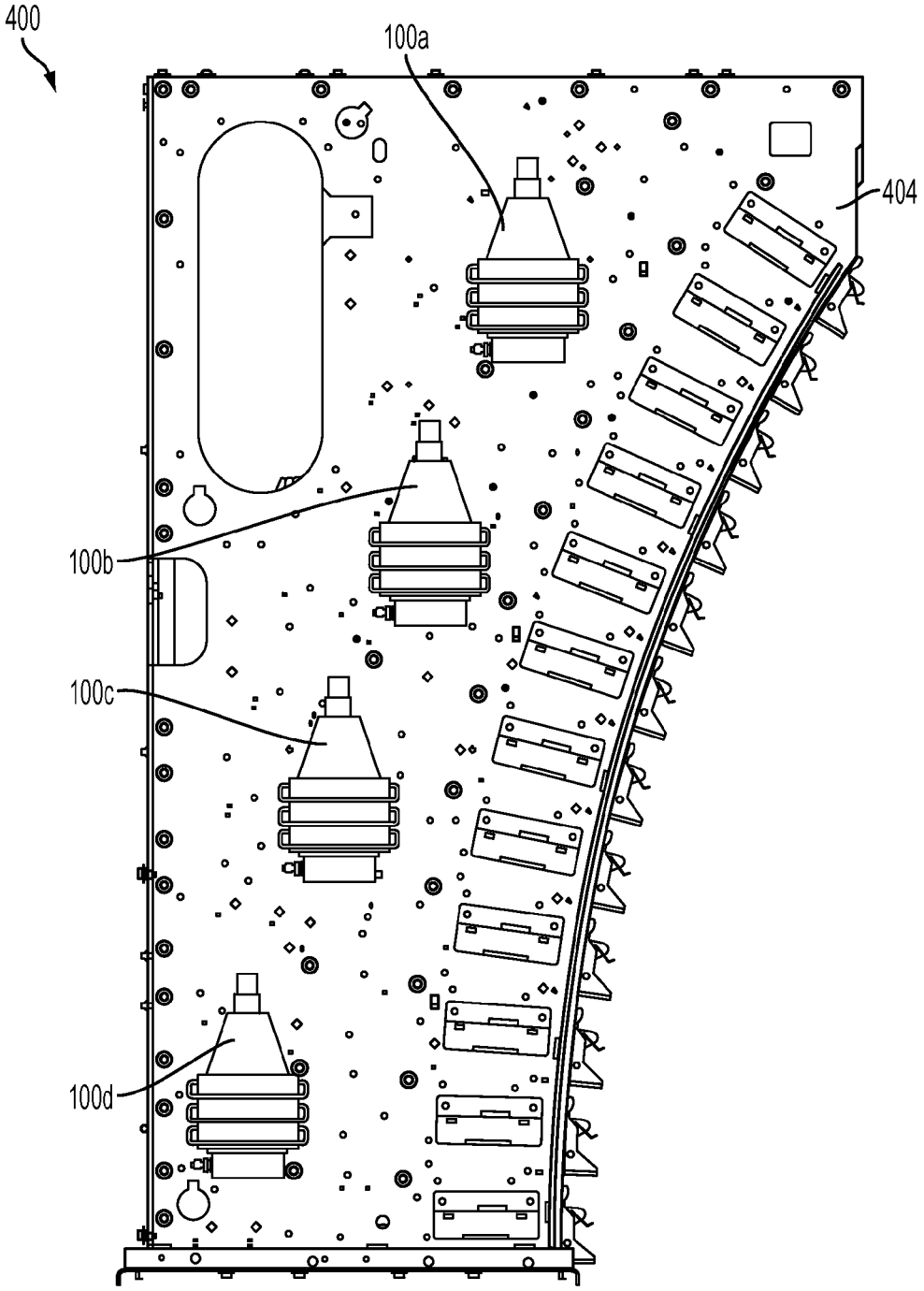
FIG. 7 is a front plan view of a melting assembly including the melting device of FIG. 1.

As shown in FIG. 7, a melting assembly 400 includes a plurality of melting devices 100*a*, 100*b*, 100*c*, 100*d* arranged on a plate 404. Each of the melting devices 100*a*-100*d* is configured to receive solid phase change ink of a different color for use in a printing process. For example, melting device 100*a* receives cyan solid phase change ink, melting device 100*b* receives yellow solid phase change ink, melting device 100*c* receives magenta solid phase change ink, and melting device 100*d* receives black solid phase change ink. After heating and filtering the ink, as described above, the melting devices 100*a*-100*d* deliver the melted phase change ink of the respective color to the printheads in the printhead module that ejects ink of that color. In an alternative embodiment, the melting assembly 400 can include more or fewer than four melting devices.

It will be appreciated that some or all of the above-disclosed features and other features and functions or alternatives thereof, may be desirably combined into many other different systems, apparatus, devices, or applications. Various presently unforeseen or unanticipated alternatives, modifications, variations, or improvements therein may be subsequently made by those skilled in the art, which are also intended to be encompassed by the following claims.

What is claimed is:

1. A melting device for melting phase change ink in a solid inkjet printer comprising:
   - a housing essentially comprised of a ferrous material, the housing including an inlet, an outlet, a reservoir fluidly communicating with the inlet, and a pair of chambers fluidly communicating with the reservoir and the outlet;
   - an electrical conductor configured in a plurality of loops surrounding the housing;
   - a pressure source in fluid communication with the pair of chambers within the housing;
   - a first valve positioned between the pair of chambers and the reservoir, the first valve being configured for selective operation to enable phase change ink melted within the housing to flow into the pair of chambers; and
   - a pair of pressure inlets positioned between the pressure source and each of the chambers within the housing, the pressure inlets being configured for selective operation to enable pressurized fluid from the pressure source to enter the housing and urge melted phase change ink from the chambers into the outlet.

2. The melting device of claim 1, the first valve being further configured to enable melted phase change ink to flow from the reservoir into only one chamber of the pair of chambers at a time.

3. The melting device of claim 1, the first valve being further configured as a spool valve.

4. The melting device of claim 1 further comprising:
   - at least one sensor positioned within at least one chamber of the pair of chambers to generate a signal indicative of an amount of liquid phase change ink within the at least one chamber.

5. The melting device of claim 4 further comprising:
   - a controller operatively connected to the at least one sensor and to the pressure source, the controller being configured to receive the signal indicative of the amount of liquid phase change ink within the at least one chamber from the at least one sensor, and to operate the pressure source to apply pressure to the at least one chamber in response to the signal exceeding a predetermined threshold.

6. The melting device of claim 1, the reservoir further comprising:
   - a plurality of fins arranged to provide heated surface area for melting phase change ink.

7. The melting device of claim 1, each chamber of the pair of chambers further comprising:
   - a plurality of fins arranged to provide heated surface area for melting phase change ink.

8. The melting device of claim 1 further comprising:
   - an alternating source of electrical energy operatively connected to the electrical conductor to pass an alternating current through the electrical conductor and produce an electromagnetic field that interacts with the ferrous material of the housing to heat the ferrous material to a temperature that enables phase change ink within the housing to melt.

9. The melting device of claim 8 further comprising:

at least one thermistor positioned within the housing to generate a signal indicative of a temperature within the housing.

10. The melting device of claim 9 further comprising:

a controller operatively connected to the at least one thermistor and to the alternating source of electrical energy, the controller being configured to receive the signal indicative of the temperature within the housing from the at least one thermistor, and to couple the alternating source of electrical energy to the electrical conductor in response to the signal from the at least one thermistor being less than a predetermined threshold.

11. A melting assembly for melting phase change ink in a solid inkjet printer comprising:

a plurality of melting devices thermally insulated from a surrounding environment, each melting device of the plurality melting devices including:

a housing essentially comprised of a ferrous material, the housing including an inlet, an outlet, a reservoir fluidly communicating with the inlet, and a pair of chambers fluidly communicating with the reservoir and the outlet;

an electrical conductor configured in a plurality of loops surrounding the housing;

a pressure source in fluid communication with the pair of chambers within the housing;

a first valve positioned between the pair of chambers and the reservoir, the first valve being configured for selective operation to enable melted phase change ink to flow into the pair of chambers; and a pair of pressure inlets positioned between the pressure source and each of the chambers within the housing, the pressure inlets being configured for selective operation to enable pressurized fluid from the pressure source to enter the housing and urge melted phase change ink from the chambers into the outlet.

12. The melting assembly of claim 11, the first valve being further configured to enable melted phase change ink to flow into only one chamber of the pair of chambers at a time.

13. The melting assembly of claim 11, the first valve being further configured as a spool valve.

14. The melting assembly of claim 11 further comprising:

at least one sensor positioned within at least one chamber of the pair of chambers to generate a signal indicative of an amount of liquid phase change ink within the at least one chamber.

15. The melting assembly of claim 14 further comprising:

a controller operatively connected to the at least one sensor and to the pressure source, the controller being configured to receive the signal indicative of the amount of liquid phase change ink within the at least one chamber from the at least one sensor, and to operate the pressure source to apply pressure to the at least one chamber in response to the signal exceeding a predetermined threshold.

16. The melting assembly of claim 11, the reservoir further comprising:

a plurality of fins arranged to provide heated surface area to melt phase change ink.

17. The melting assembly of claim 11, each chamber of the pair of chambers further comprising:

a plurality of fins arranged to provide heated surface area to melt phase change ink.

18. The melting assembly of claim 11, each melting device further comprising:

an alternating source of electrical energy operatively connected to the electrical conductor to pass an alternating current through the electrical conductor and produce an electromagnetic field that interacts with the ferrous material of the housing to heat the ferrous material to a temperature that enables phase change ink within the housing to melt.

19. The melting assembly of claim 18 further comprising:

at least one thermistor positioned within the housing to generate a signal indicative of a temperature within the housing.

20. The melting assembly of claim 19 further comprising:

a controller operatively connected to the at least one thermistor and to the alternating source of electrical energy, the controller being configured to receive the signal indicative of the temperature within the housing from the at least one thermistor, and to couple the alternating source of electrical energy to the electrical conductor in response to the signal from the at least one thermistor being less than a predetermined threshold.

* * * * *